US012655591B1

(12) United States Patent
Pautz

(10) Patent No.: US 12,655,591 B1
(45) Date of Patent: Jun. 16, 2026

(54) MODULAR DRAINAGE DEVICE AND SYSTEM

(71) Applicant: Douglas Robinson, Royce City, TX (US)

(72) Inventor: Jason Maxwell Pautz, Dallas, TX (US)

(73) Assignee: Douglas Robinson, Royse City, AS (US)

( * ) Notice: Subject to any disclaimer, the term of this patent is extended or adjusted under 35 U.S.C. 154(b) by 0 days.

(21) Appl. No.: 19/237,575

(22) Filed: Jun. 13, 2025

(51) Int. Cl.

| | |
|---|---|
| ***E02D 11/00*** | (2006.01) |
| ***E02B 11/00*** | (2006.01) |
| ***E02D 31/02*** | (2006.01) |
| ***E03F 1/00*** | (2006.01) |

(52) U.S. Cl.
CPC ..... *E02B 11/005* (2013.01); *E02D 31/02* (2013.01); *E03F 1/002* (2013.01)

(58) Field of Classification Search
CPC ..... E02B 11/005; E03F 1/002; E03F 1/005; E02D 31/02
See application file for complete search history.

(56) References Cited

U.S. PATENT DOCUMENTS 2,135,103 A * 11/1938 Dimick ..... E02B 11/005 405/47
6,223,777 B1 * 5/2001 Smith ..... E04D 13/08 138/119
7,419,332 B1 * 9/2008 Brochu ..... E02B 11/005 405/49
8,689,837 B1 * 4/2014 Smith ..... F16L 11/121 285/179
2003/0031512 A1 * 2/2003 Goddard ..... E03F 1/002 405/45
2005/0175419 A1 * 8/2005 Parker ..... E02B 11/005 405/302.7
2012/0068452 A1 * 3/2012 Boettner ..... E04D 13/08 138/140

FOREIGN PATENT DOCUMENTS

RU 176680 U1 * 1/2018 ..... E02B 11/005

* cited by examiner

*Primary Examiner* — Amber R Anderson
*Assistant Examiner* — Stacy N Lawson
(74) *Attorney, Agent, or Firm* — Stephen Y. Liu; Stephanie E. Scoggin; Carstens, Allen & Gourley, LLP

(57) ABSTRACT

A drainage assembly module comprising a body formed from walls that define an enclosed fluid channel extending from an inflow end to an outflow end. The module also includes at least one support member extending from at least one of the walls and spanning the fluid channel. The module also includes a first locking mechanism disposed on at least one of the walls and located proximate to an opening at the outflow end, and a second locking mechanism disposed on at least one of the walls and located proximate to the opening at the inflow end. The opening at the inflow end of the fluid channel has a smaller cross-sectional area than the opening at the outflow end of the fluid channel. The shape of the first locking mechanism is configured to removably engage with a shape of the second locking mechanism.

19 Claims, 11 Drawing Sheets

MODULAR DRAINAGE DEVICE AND SYSTEM

TECHNICAL FIELD

The present disclosure relates in general to the field of fluid drainage systems, and more particularly to a novel modular drainage device for the construction of customizable drainage systems, as well as related systems and methods of manufacturing and use.

BACKGROUND

Fluid drainage systems are commonly used to convey rainwater or other fluids away from structures to prevent water accumulation and associated damage. Effective drainage systems are essential in maintaining the structural integrity of buildings and mitigating flooding or erosion risks. Effective drainage systems are crucial for directing water away from structures to prevent damage and maintain the integrity of buildings and landscapes. Without proper drainage, rainwater and surface runoff can accumulate around foundations, leading to moisture infiltration, soil erosion, and structural damage over time. Improper drainage can also wash away topsoil and destabilize the ground, leading to greater drainage problems, significant land loss, and decreased fertility. As such, improper fluid drainage can compromise both the safety and aesthetic value of a property. A well-designed drainage system helps mitigate these risks by ensuring water is efficiently channeled away, preserving the structural health and longevity of buildings and landscapes.

Drainage pipes are among the components used to form traditional drainage systems. Drainage pipes are typically installed below ground or along building exteriors, directing runoff from roof gutters or paved surfaces to designated drainage areas, such as storm drains or retention ponds. However, there are a number of drawbacks associated with traditional drainage pipes. For example, traditional drainage pipes are not easily customizable, lack structural support, and are often clogged with debris, leading to improper drainage and flooding.

Drainage pipes are typically sold in long, standard-length sections, such as 10 to 20 feet, which makes it challenging to obtain the precise length needed for a specific installation. Since specialized tools are required to cut most drainage pipes, many drainage systems include drainage piping that is either too long or too short. Additionally, drainage pipes are typically made from rigid materials like PVC, which do not offer the flexibility to bend or conform easily to irregular shapes or terrain. These drainage pipe characteristics lead to inefficiencies in the drainage system and potential fluid flow issues. To address these issues, some drainage pipes are made from more flexible material that is easier to cut and manipulate. However, these flexible drainage pipes lack structural support, which can lead to cracking or collapsing with soil movement and overhead weight. Traditional drainage pipes are also often clogged with debris, leaves, and sediment. Over time, these blockages can restrict water flow, causing backups that result in improper drainage and flooding. In addition, the accumulation of debris can accelerate wear and tear on the drainage pipes, increasing the risk of leaks. Regular maintenance is required to clear these blockages, adding to the cost and labor involved in keeping the drainage system functional and preventing potential fluid damage.

What is needed in the art is a modular drainage device for forming customizable fluid drainage systems, and related methods of manufacturing, installation, and use, that do not suffer from deficiencies found in conventional drainage devices and systems.

SUMMARY

Novel aspects of the present disclosure are directed to a drainage assembly module comprising a body formed from walls that define an enclosed fluid channel extending from an inflow end to an outflow end, wherein the body at least partially tapers from the inflow end to the outflow end. The drainage assembly module also includes at least one support member extending from at least one of the walls and spanning the fluid channel. The drain structure module also includes a first locking mechanism disposed on at least one of the walls and located proximate to an opening at the outflow end, and a second locking mechanism disposed on at least one of the walls and located proximate to the opening at the inflow end. The opening at the inflow end of the fluid channel has a first cross-sectional area and the opening at the outflow end of the fluid channel has a second cross-sectional area that is smaller than the first cross-sectional area. The shape of the first locking mechanism is configured to removably engage with a shape of the second locking mechanism.

In another embodiment, novel aspects of the disclosed principles are directed to a system comprising a first drainage assembly module and a second drainage assembly module removably coupled to the first drainage assembly module. Each drain structure module includes a body formed from a plurality of walls that define an enclosed fluid channel extending from an inflow end to an outflow end. Each drainage assembly module also includes at least one support member extending from at least one of the walls and spanning the fluid channel. Each drainage assembly module also includes a first locking mechanism disposed on at least one of the walls and located proximate to an opening at the outflow end, and a second locking mechanism disposed on at least one of the walls and located proximate to the opening at the inflow end. The opening at the inflow end of the fluid channel has a first cross-sectional area and the opening at the outflow end of the fluid channel has a second cross-sectional area that is smaller than the first cross-sectional area. The shape of the first locking mechanism is configured to removably engage with a shape of the second locking mechanism. The first locking mechanism of the first drainage assembly module is removably engaged with the second locking mechanism of the second drainage assembly module to form an elongated fluid channel extending from the inflow end of the first drainage assembly module to the outflow end of the second drainage assembly module.

Other aspects, embodiments, and features of the disclosed principles will become apparent from the following detailed description when considered together with the accompanying figures. In the figures, each identical or substantially similar component that is illustrated in various figures is represented by a single numeral or notation. For the purposes of clarity, not every component is labeled in every figure. Nor is every component of each embodiment of the disclosed principles shown where illustration is not necessary to allow those of ordinary skill in the art to understand the principles disclosed herein.

BRIEF DESCRIPTION OF THE DRAWINGS

The novel features believed characteristic of the disclosure are set forth in the appended claims. The disclosure itself, however, as well as a preferred mode of use, further objectives, and advantages thereof, will be best understood by reference to the following detailed description of illustrative embodiments when read in conjunction with the accompanying drawings, in which:

INDEX OF REFERENCE NUMERALS AND DEFINITIONS

Figure 1:
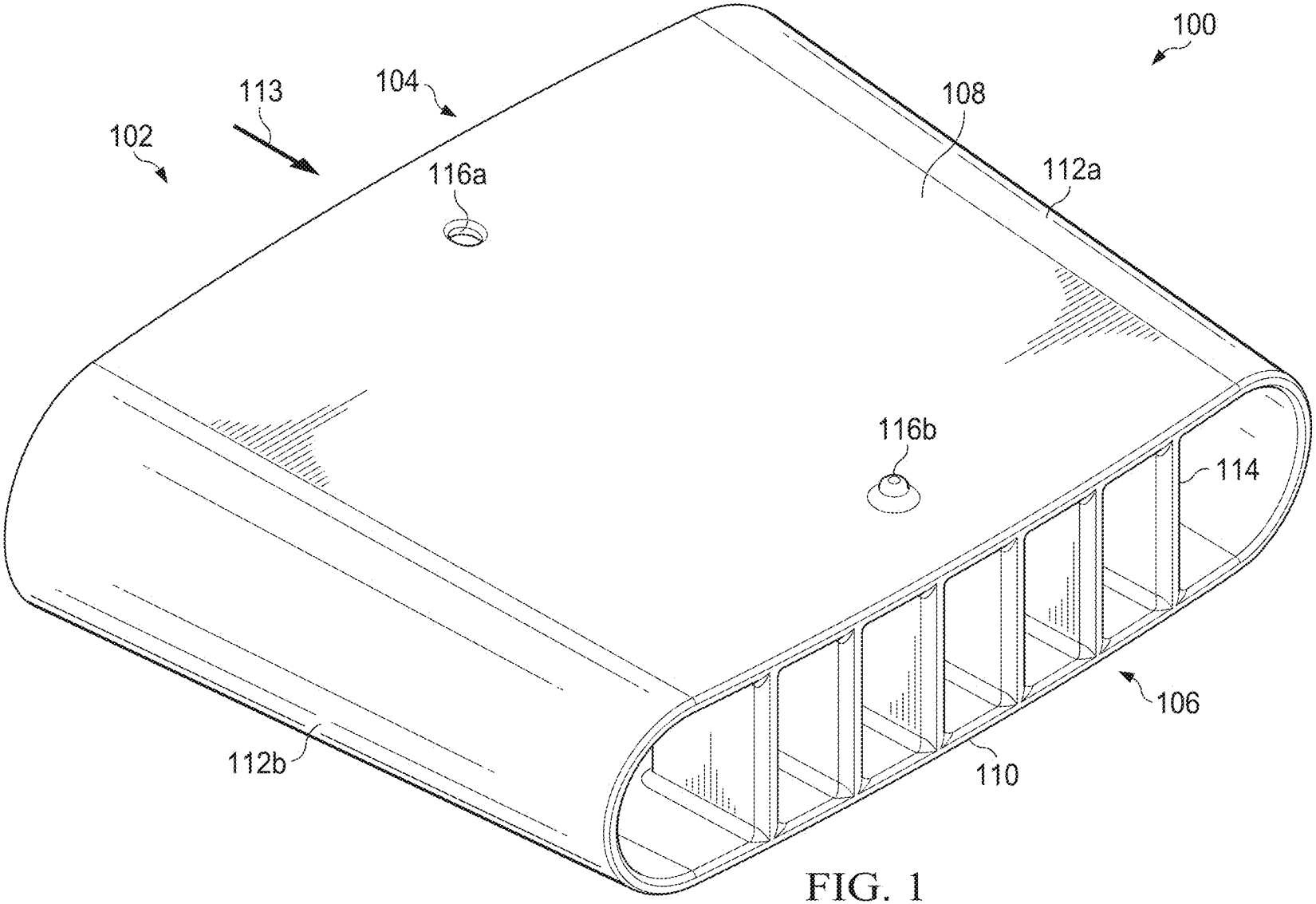
FIG. 1 illustrates a perspective view of one embodiment of a drainage structure module designed and constructed in accordance with the disclosed principles.

| Reference | Element |
|---|---|
| 100 | modular drainage device or module |
| 102 | fluid channel |
| 104 | inflow end |
| 106 | outflow end |
| 108 | first planar surface |
| 110 | second planar surface |
| 112 | sidewall member |
| 113 | arrow |
| 114 | support member |
| 116 | locking mechanisms |
| 116a | inflow locking mechanism |
| 116b | outflow locking mechanism |
| 500 | modular drainage device assembly or assembly |
| 502 | outflow end |
| 504 | first module |
| 506 | inflow end |
| 508 | second module |
| 510 | arrow |
| 512 | locking mechanism |
| 512a | outflow locking mechanism |
| 512b | inflow locking mechanism |
| 516 | elongated fluid channel |
| 518 | arrow |
| 520 | third module |
| 522 | arrow |
| 523 | arrow |
| 524 | arrow |
| 602 | cover |
| 604 | support member |
| 702 | first planar surface |
| 704 | second planar surface |
| 706 | first planar surface |
| 708 | second planar surface |

-continued

INDEX OF REFERENCE NUMERALS AND DEFINITIONS

| Reference | Element |
|---|---|
| 802 | pipe adapter |
| 804 | fluid channel |
| 806 | inflow end |
| 808 | outflow end |
| 810 | first planar surface |
| 812 | sidewall member |
| 816 | drainpipe adapter |
| 818 | elbow joint |
| 819 | inflow end |
| 820 | outflow end |
| 822 | first planar surface |
| 824a | smaller sidewall member |
| 824b | larger sidewall member |
| 826 | elongated fluid channel |
| 828 | arrow |
| 1100 | pipe adapter |
| 1102 | fluid channel |
| 1104 | inflow end |
| 1106 | outflow end |
| 1108 | first planar surface |
| 1110a | sidewall member |
| 1110b | sidewall member |
| 1114 | drainpipe adapter |

DETAILED DESCRIPTION

Novel aspects of this disclosure recognize the need for a customizable drainage system that does not compromise on structural support. To this end, an improved modular drainage device is provided that can be linked to construct a drainage system tailored to the unique needs of a given environment.

FIGS. 1-4 illustrate various perspectives of one embodiment of a modular drainage device 100 designed and constructed in accordance with the disclosed principles. Referring to FIG. 1, illustrated is an isometric view of one embodiment of a modular drainage device 100. The module 100 may include a fluid channel 102 with an inflow end 104 and an outflow end 106. In the non-limiting embodiment depicted in FIG. 1, the fluid channel 102 may be defined by body comprising a first planar surface 108, a second planar surface 110, and two sidewall members 112*a*, 112*b* that join the first planar surface 108 to the second planar surface 110. In exemplary embodiments, when referring to a module 100 as disclosed herein, the first planar surface 108 may be referred to as the top surface 108 of the module 100, while the second planar surface 110 may be referred to as the bottom surface 110 of the module 100. The first planar surface 108 and the second planar surface 110 may gradually taper toward one another from the inflow end 104 to the outflow end 108 without intersecting. Similarly, the sidewall members 112*a*, 112*b* may also taper from the inflow end 104 to the outflow end 106, giving the module 100 a truncated arrowhead shape when viewed perpendicularly from the top of the first planar surface 108, or when viewed perpendicularly from the top of the second planar surface 110.

As illustrated in FIG. 1, the sidewall members 112*a*, 112*b* may be curved to improve fluid flow through the fluid channel 102. With curved sidewall members 112*a*, 112*b*, the openings of the fluid channel 102 may have the shape of geometric stadium or discorectangle when viewing the inflow end 104 or the outflow end 106 perpendicularly. A "stadium" shape in geometry is a two-dimensional shape made up of a rectangle with semicircles attached to opposite sides, for example, a pill shape when viewed perpendicularly from the side. Such a shape may also be called a "discorectangle" or "obround", and is commonly used as the start or termination of a flow diagram. In other embodiments, the cross-sectional shape of the module 100 when viewed perpendicularly from the inflow end 104 or outflow end 106 may be an ellipse, a circle, an oval, or another advantageous shape.

The module 100 may be formed of a durable yet partially flexible material, such as plastic. As non-limiting examples, the module 100 may be formed from materials including but not limited to flexible polyvinyl chloride (PVC), high-density polyethylene (HDPE), and the like. In other embodiments, the material for the module 100 may be rigid materials such as a metal or other similar inflexible or semi-rigid materials. Other materials that provide the same utility are within the scope of the claims.

The module 100 may axially taper from the inflow end 104 toward the outflow end 106 such that the cross-sectional area of the opening at the outflow end 106 is smaller than the cross-sectional area of the opening at the inflow end 104. To achieve the tapering shape, the width of one or more of the sidewall members 112*a*, 112*b*, first planar surface 108, and second planar surface 110 may be wider at the inflow end 104 and narrower at the outflow end 106 such that the sidewall members 112*a*, 112*b* may gradually move closer together from the inflow end 104 to the outflow end 106. The height of sidewall members 112*a*, 112*b* may also be greater on the inflow end 108 and smaller on the outflow end 110 such that the first planar surface 108 and the second planar surface 110 may gradually move closer together from the inflow end 104 to the outflow end 106. The tapering shape of the module 100 may facilitate the flow of fluid through the fluid channel 102 from the inflow end 104 toward the outflow end 106 in the direction of arrow 113. Tapering from the inflow end 104 toward the outflow end 106 may also facilitate a connection of two modules 100, wherein the narrower outflow end 106 of a first module 100 fits into the wider inflow end 104 of a second module 100. The interconnection of modules 100 is discussed in greater detail with reference to FIG. 5.

The module 100 may also include support members 114. Support members 114 may provide structural support for the module 100 to prevent deformation and damage from external forces such as soil movement and overhead weight. Support members 114 may be sized and positioned to provide structural support for the module 100 without obstructing the flow of fluid through the fluid channel 102. In the non-limiting exemplary embodiment illustrated in FIG. 1, the support members 114 may be substantially parallel ribs extending perpendicularly between the first planar surface 108 and the second planar surface 110. In another embodiment, the support members 114 may be a honeycomb or other grid structure extending between the first planar surface 108 and the second planar surface 110. In yet another embodiment, the support members 114 may be x-shaped structures extending between the first planar surface 108 and the second planar surface 110. The support structures 114 may optionally contact the sidewall members 112*a*, 112*b* to provide support across the entire width of the fluid channel 102. Many other embodiments of support members that can achieve the same utility are within the scope of the principles disclosed herein and the appended claims, but are not presented here for the sake of brevity.

As previously discussed, the inflow end 104 of the module 100 may be configured to receive the outflow end 106 of another module 100. It may therefore be desirable to avoid obstructing the inflow end 104 to facilitate the coupling of one module 100 to another. Accordingly, the support members 114 may not be disposed throughout the entire length of the module 100. Instead, the support members 114 may be disposed only near the outflow end 106 of the module 100. In the non-limiting exemplary embodiment illustrated in FIG. 1, the support members 114 may be disposed near the opening of the outflow end 106 and extend less than a quarter of the way down the length of the module 100. In another non-limiting exemplary embodiment, the support members 114 may be disposed near the opening of the outflow end 106 and extend only a quarter of the way down the module 100 toward the inflow end 104. In yet another non-limiting exemplary embodiment, the support members 114 may be disposed near the opening of the outflow end 106 and extend half-way down the module 100. As a result of this arrangement, the outflow end 106 of the module 100 may be more rigid, while the inflow end 104 of the module 100 may be more flexible. Accordingly, the inflow end 104 of a first module 100 may be able to flex to receive the outflow end 106 of a second module 100. When two modules 100 are coupled, as discussed in greater detail with reference to FIG. 5, the support members 114 of a first module 100 may provide structural support for the outflow end 106 of the first module 100 as well as the inflow end 104 of the second module 100 which received it.

The module 100 may also include locking mechanisms to securely and removably couple two modules 100 together. The locking mechanisms may include an inflow locking mechanism 116*a* disposed near the inflow end 104 and an outflow locking mechanism 116*b* disposed near the outflow end 106 (collectively referred to as "locking mechanisms 116"). The inflow locking mechanism 116*a* may be any locking mechanism capable of securely and removably engaging the outflow locking mechanism 116*b* of a second module 100, and vice versa. In the non-limiting exemplary embodiment illustrated in FIG. 1, the inflow locking mechanism 116*a* may be an aperture and the outflow locking mechanism 116*b* may be a generally outward facing protuberance, protrusion, projection, or nub sized and positioned to removably engage with the aperture shape of the inflow locking mechanism 116*a*. In an embodiment, the nub forming the outflow locking mechanism 116*b* may be a fixed protrusion extending from the module 100. In an alternative embodiment, the nub forming the outflow locking mechanism 116*b* may be a spring-loaded nub. Other examples of locking mechanisms that can achieve the same utility are within the scope of the principles disclosed herein and the appended claims.

As a non-limiting example, the locking mechanisms 116 may include a latch and a lip, wherein the latch is configured to engage the lip. It will be understood by those skilled in the pertinent field of art that the locking mechanisms 116 may be interchangeable. As a non-limiting example, the outflow locking mechanism 116*b* may be an aperture and the inflow locking mechanism 116*a* may be a generally inward facing nub. The locking mechanisms 116 may be disposed on one or both of the first planar surface 108 and the second planar surface 110, as will be illustrated in the figures that follow. The locking mechanisms 116 may also be configured to provide a pivot point about which two connected modules 100 may be partially rotated. As a non-limiting example, in an embodiment wherein the outflow locking mechanism 116*b* is a nub and the inflow locking mechanism 116*a* is an aperture, the outflow locking mechanisms 116*b* of a first module 100 may partially rotate within the coupled inflow locking mechanism 116*a* of an connected second module 100 such that the orientation of the first module 100 relative to the second module 100 may be altered. In such embodiments, the size of the inflow end of one module 100 receiving the outflow end of another module 100 may be selected such that only a predetermined amount of pivot or rotation about the locking mechanisms 116 is permitted between any two modules 100. For example, such size may be selected such that when a plurality of modules 100 are interconnected (i.e., one outflow end to another inflow end) to form a drainage system, a predetermined radius of curvature for the connected plurality of modules 100 will have a range between a minimum radius and a substantially straight collection of modules 100. Additionally, the distance between the locking mechanisms 116 and the opening of the fluid channel 102 may be selected such that only a predetermined amount of pivot or rotation about the locking mechanism 116 is permitted between any two modules 100. The locking mechanisms 116 are discussed in greater detail in FIGS. 5-7.

The module 100 may also include guide members (not shown) configured to guide the outflow locking mechanisms 116*b* of a first module 100 toward the inflow locking mechanisms 116*b* of a second module 100. As a non-limiting example, the guide members may be channels extending from the opening of the inflow end 104 to the inflow locking mechanism 116*a* and/or from the opening of the outflow end 106 to the outflow locking mechanism 116*b*. In another embodiment, the guide members may be rails extending from the opening of the fluid channel 102 to the adjacent locking mechanism 116. The guide members may be disposed on one or more of the first planar surface 108 and the second planar surface 110.

Figure 2:
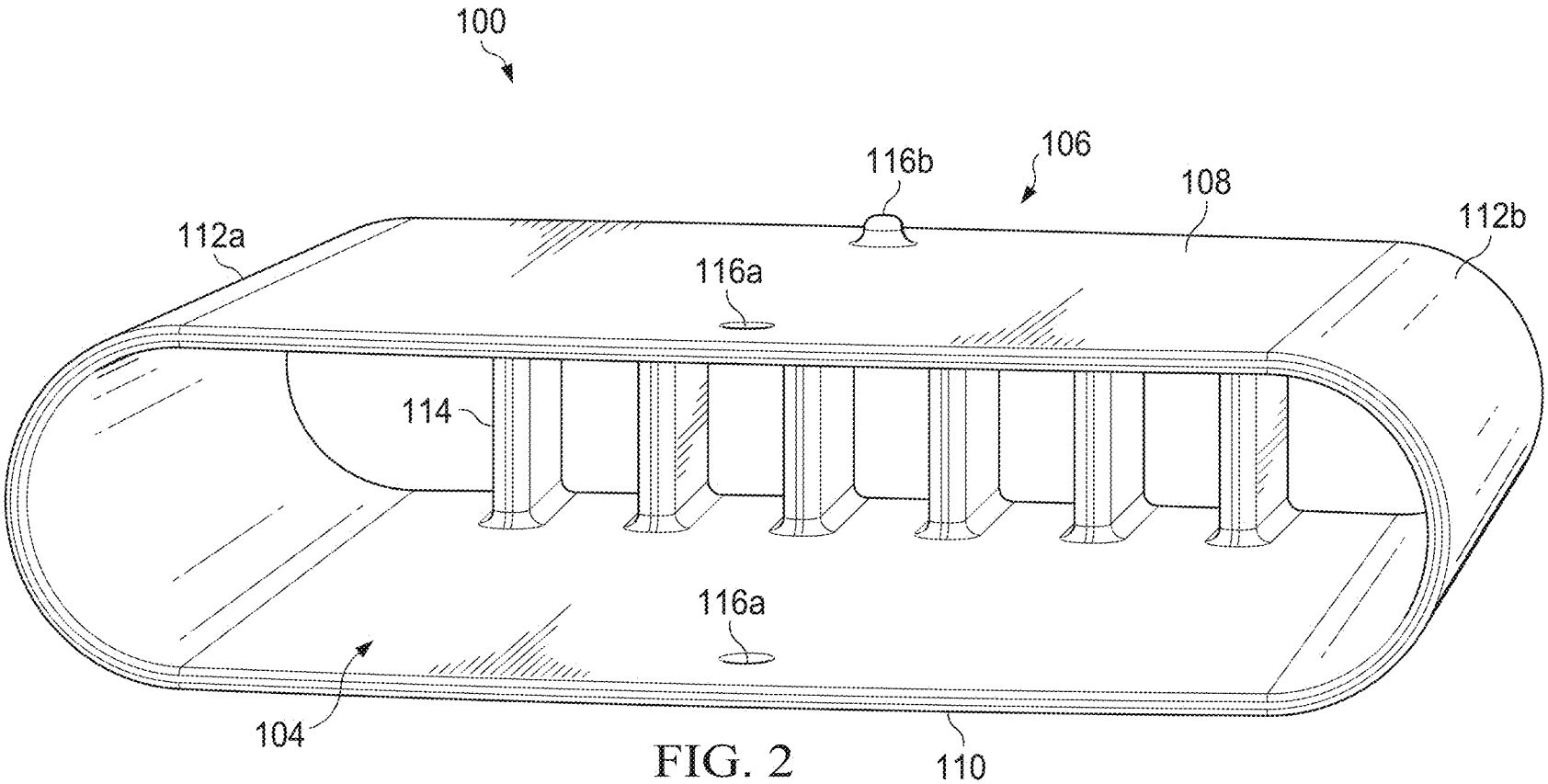
FIG. 2 illustrates a back perspective view of an exemplary embodiment of a drainage structure module.

Referring to FIG. 2, illustrated is a back perspective view of an exemplary embodiment of a module 100 designed and constructed in accordance with the disclosed principles. In the non-limiting exemplary embodiment illustrated in FIG. 2, the module 100 may include locking mechanisms 116 disposed on both the first planar surface 108 and the second planar surface 110. As previously discussed, the support members 114 may not extend throughout the full length of the module 100. In the non-limiting exemplary embodiment illustrated in FIG. 2, the support members 114 extend less than a quarter of the way down the length of the module 100, which prevents them from obstructing the insertion of the outflow end of a second module (not illustrated) into the inflow end 104 of the illustrated module 100.

Figure 3:
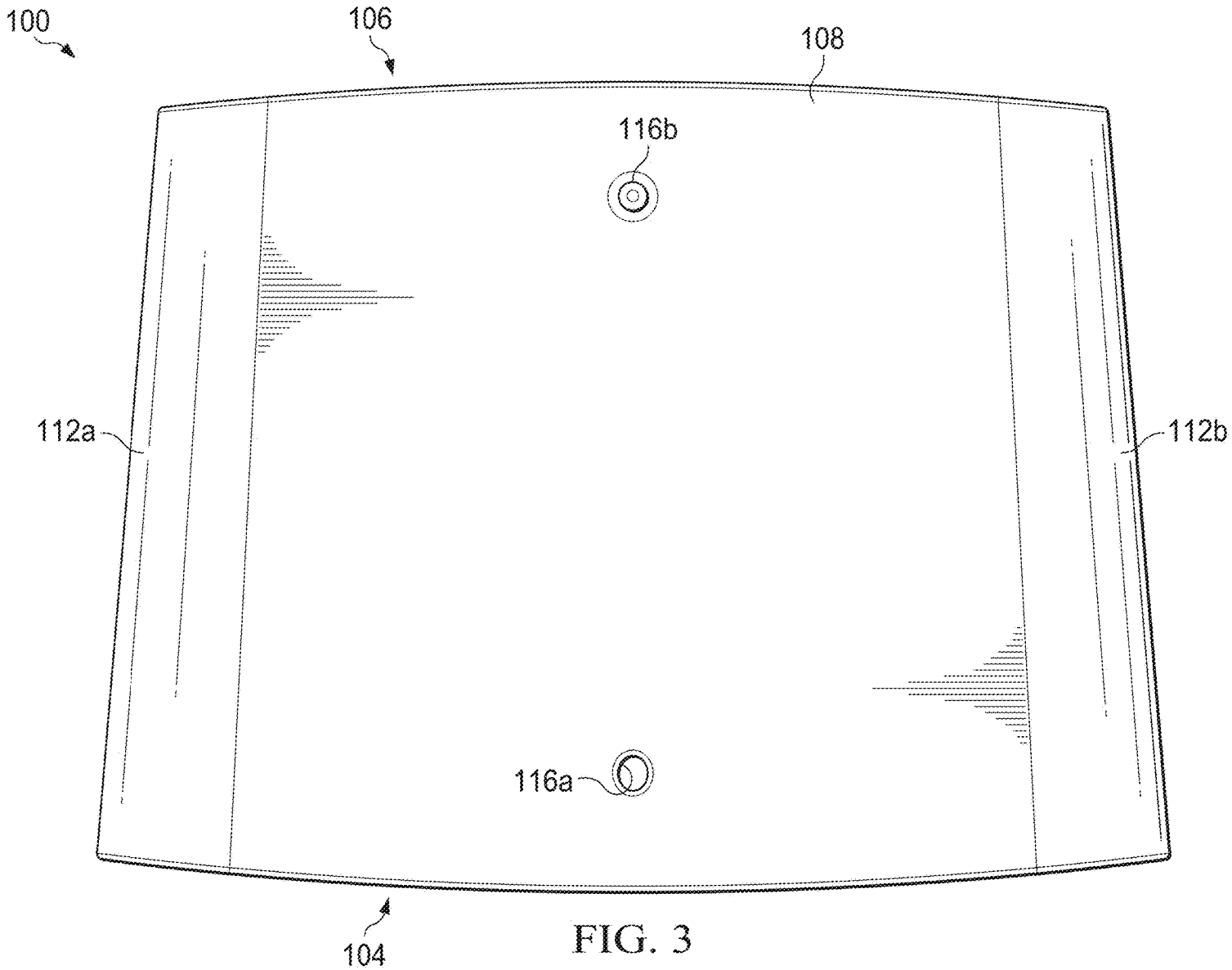
FIG. 3 illustrates a top elevation view of an exemplary embodiment of a drainage structure module.

Referring to FIG. 3, illustrated is a top elevation view of an exemplary embodiment of a module 100 designed and constructed in accordance with the disclosed principles. As previously discussed, the module 100 may gradually taper from the inflow end 104 toward the outflow end 106 such that the cross-sectional area of the opening at the inflow end 104 is greater than the cross-sectional area of the opening at the outflow end 106. In the non-limiting exemplary embodiment illustrated in FIG. 3, the width of the sidewall members 112*a*, 112*b* may be wider at the inflow end 104 and narrower at the outflow end 106. Additionally, the width of the first planar surface 108 and the width of the second planar surface (not shown) may be wider at the inflow end 104 and narrower at the outflow end 106. The sidewall members 112*a*, 112*b* may thereby gradually move closer together from the inflow end 104 to the outflow end 106 to achieve the tapering shape of the module 100.

Figure 4:
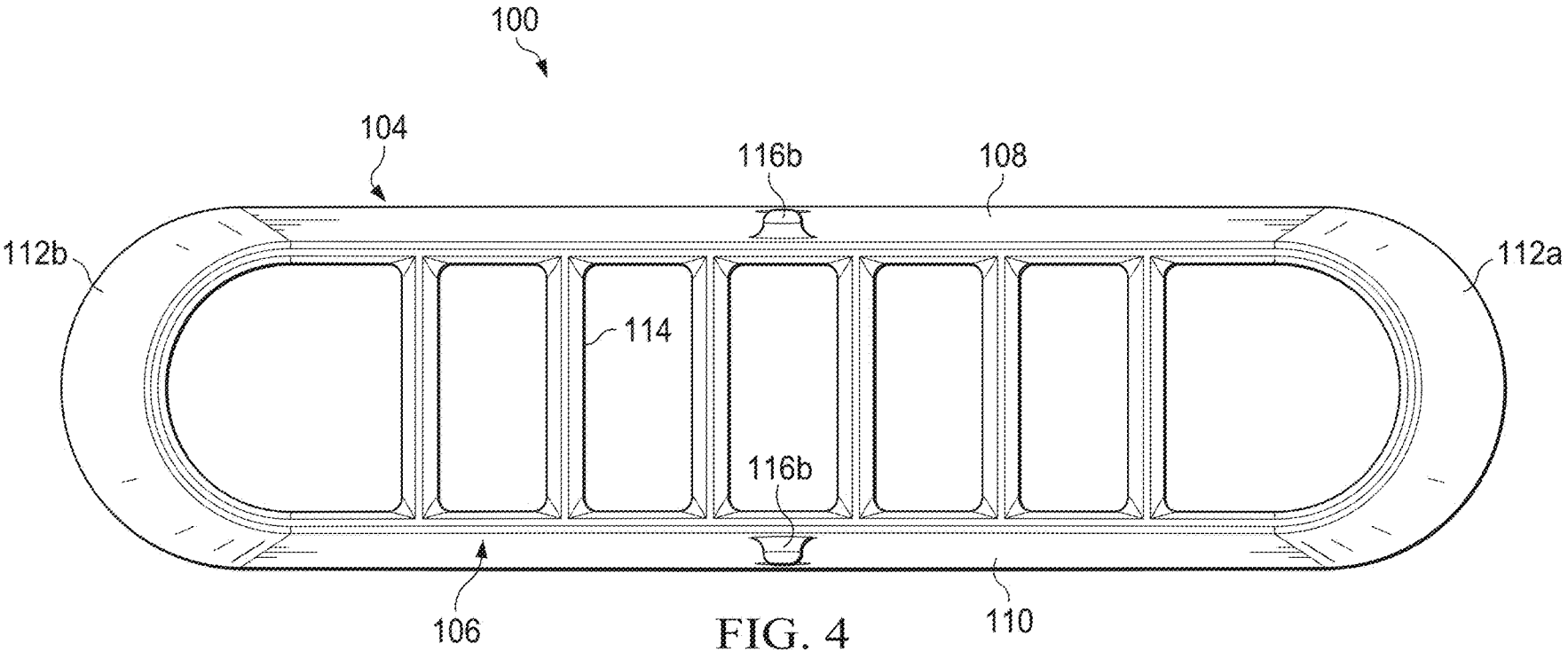
FIG. 4 illustrates a front elevation view of an exemplary embodiment of a drainage structure module.

Referring to FIG. 4, illustrated is a front elevation view of an exemplary embodiment of a module 100 designed and constructed in accordance with the disclosed principles. In the non-limiting exemplary embodiment illustrated in FIG. 4, the height of sidewall members 112*a*, 112*b* may be greater on the inflow end 108 and smaller on the outflow end 110. The first planar surface 108 and the second planar surface 110 may thereby gradually move closer together from the inflow end 104 to the outflow end 106 to achieve the axially tapering shape of the module 100. As previously discussed, the module 100 may also include locking mechanisms 116 disposed on both the first planar surface 108 and the second planar surface 110.

Figure 5:
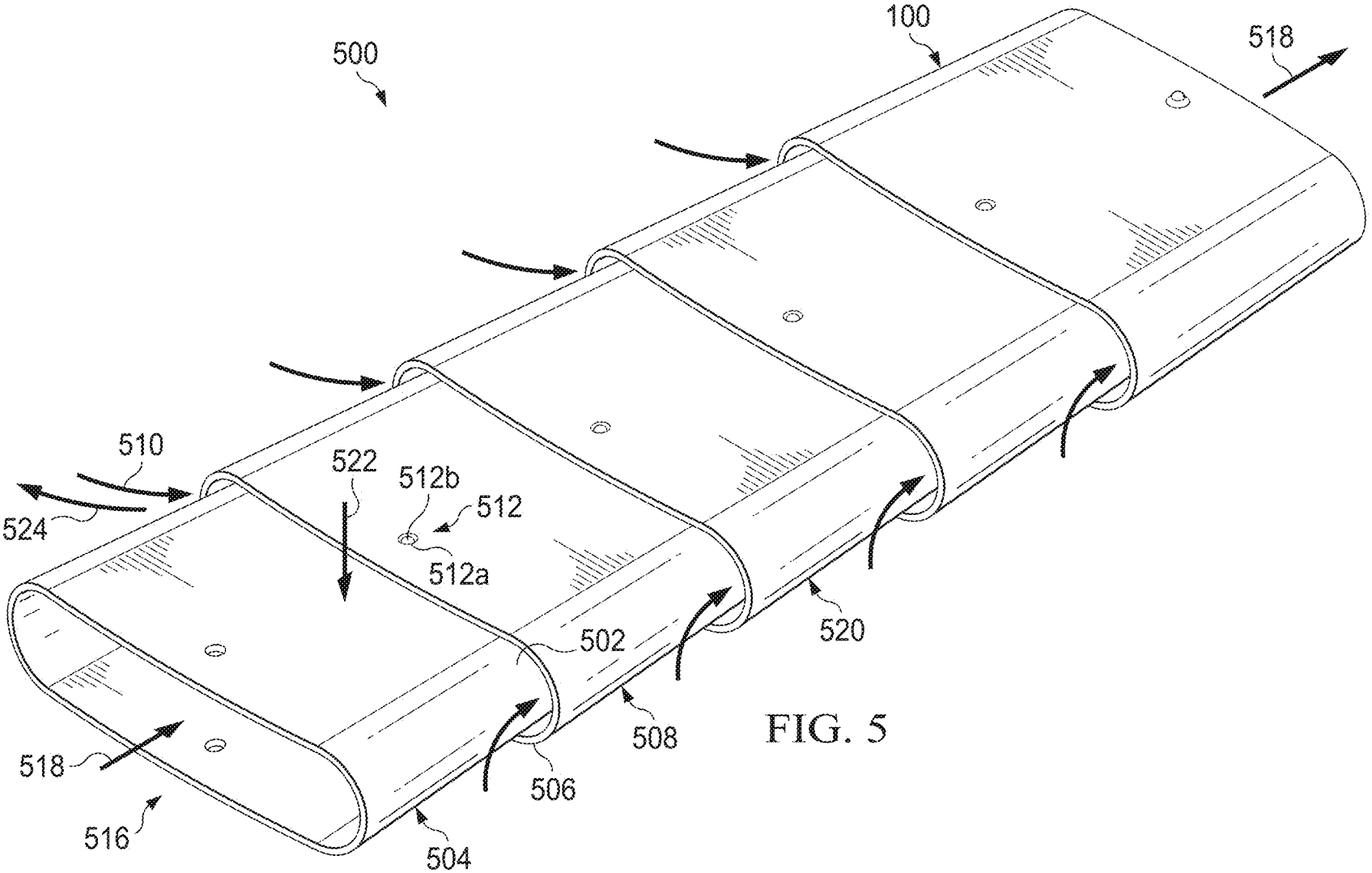
FIG. 5 illustrates a perspective view of an exemplary embodiment of a plurality of interconnected drainage structure modules arranged in a straight formation.

Referring to FIG. 5, illustrated is an isometric view of an exemplary embodiment of a modular drainage assembly 500 arranged in a straight configuration in accordance with the disclosed principles. As previously discussed, two modules 100 may be securely coupled to one another. In the same way, a plurality of modules 100 may be interconnected to form a customizable drainage assembly. In the non-limiting embodiment illustrated in FIG. 5, five modules 100 may be interconnected to form a modular drainage assembly 500. One of ordinary skill in the pertinent art will recognize that a modular drainage assembly 500 is not limited to five modules 100, and the length of a modular drainage assembly 500 can be varied (e.g., by connecting more or fewer modules 100). As previously discussed, two modules 100 may be connected by fitting the outflow end of one module into the inflow end of another module. In the non-limiting exemplary embodiment illustrated in FIG. 5, the outflow end 502 of a first module 504 can correspond to the shape and taper of the inflow end 506 of a second module 508 such that the outflow end 502 of a first module 504 may be matingly received by the inflow end 506 of the second module 508. More specifically, with the first module 504 and the second module 508 positioned such that the outflow end 502 of the first module 504 is aligned with the inflow end 506 of the second module 508, the first module 504 can be moved in the direction of arrow 510 to fit the outflow end 502 of the first module 504 into the inflow end 506 of the second module 508, thereby coupling the two modules 504, 508 together.

The locking mechanisms 512 may be engaged to secure the connection between the first module 504 and the second module 508. In the non-limiting exemplary embodiment illustrated in FIG. 5, the outflow locking mechanism 512*b* of the first module 504 may be sized and positioned to engage the inflow locking mechanism 512*a* of the second module 508 when the first module 504 is received by the second module 508. As a non-limiting example, the inflow locking mechanism 512*a* may be an aperture sized and positioned to frictionally receive the outflow locking mechanism 512*b*, which may be a generally outward facing nub.

The steps of fitting the outflow end 502 of a first module 504 into the inflow end 506 of a second module 508 and frictionally coupling the outflow locking mechanism 512*b* of the first module 504 with the inflow locking mechanism 512*a* of the second module 508 may be repeated with a plurality of modules 100. That is, the outflow end 502 of the second module 508 may be fit into the inflow end 506 of a third module 520 and so on. Likewise, the outflow locking mechanism 512*b* of the second module 508 may be frictionally coupled to the inflow locking mechanism 512*a* of the third module 520. A plurality of modules 100 may be interconnected to form a modular drainage assembly 500, wherein the fluid channels 102 of each module 100 align to form an elongated fluid channel 516. The elongated fluid channel 516 may be segmentally tapered as a result of the tapered shape of each module 100. Fluid may thereby flow through the elongated fluid channel 516 in the direction of arrow 518.

It may be desirable to disconnect one or more modules 100 from the assembly 500 to modify the length of the assembly 500. A module 100 may be disconnected from the assembly 500 by disengaging the locking mechanisms 512. In the non-limiting exemplary embodiment illustrated in FIG. 5, a pressing force in the direction of arrow 522 may cause the outflow locking mechanism 512*b* of the first module 504 to disengage from the inflow locking mechanism 512*a* of the second module 508. Alternatively, the inflow end of the second module 508 may be manually opened (e.g., the first planar surface of the second module 508 lifted from the outflow end of the first module 504) to separate the first and second modules 506, 508. With the locking mechanisms 512 disengaged, the first module 504 may be separated from the second module 508 by moving the first module 504 in the direction of arrow 524. The steps of disengaging the locking mechanisms 512 and separating the first module 504 from the second module 508 may be repeated with a plurality of modules 100 to form an assembly of a desired length. The uncoupled modules 100 may be connected to one another by following the steps described above to form a new modular drainage assembly. Accordingly, the modules 100 may be interconnected in a variety of configurations to form customizable fluid drainage systems. Additionally, each of the plurality of modules 100 may be pivoted in either left or right directions with respect to the module(s) it is coupled to so that the assembly 500 may be formed into a curved assembly in either direction, or even a serpentine shape by curving one or more modules in alternating directions, or any combination thereof. As discussed above, the amount of curvature(s) is determined based on either or both the width of the outflow end of a module as compared to the width of the inflow end of its mating module, and the distance the locking mechanisms of each module are spaced from the outer edge of the outflow end of each module.

Figure 6:
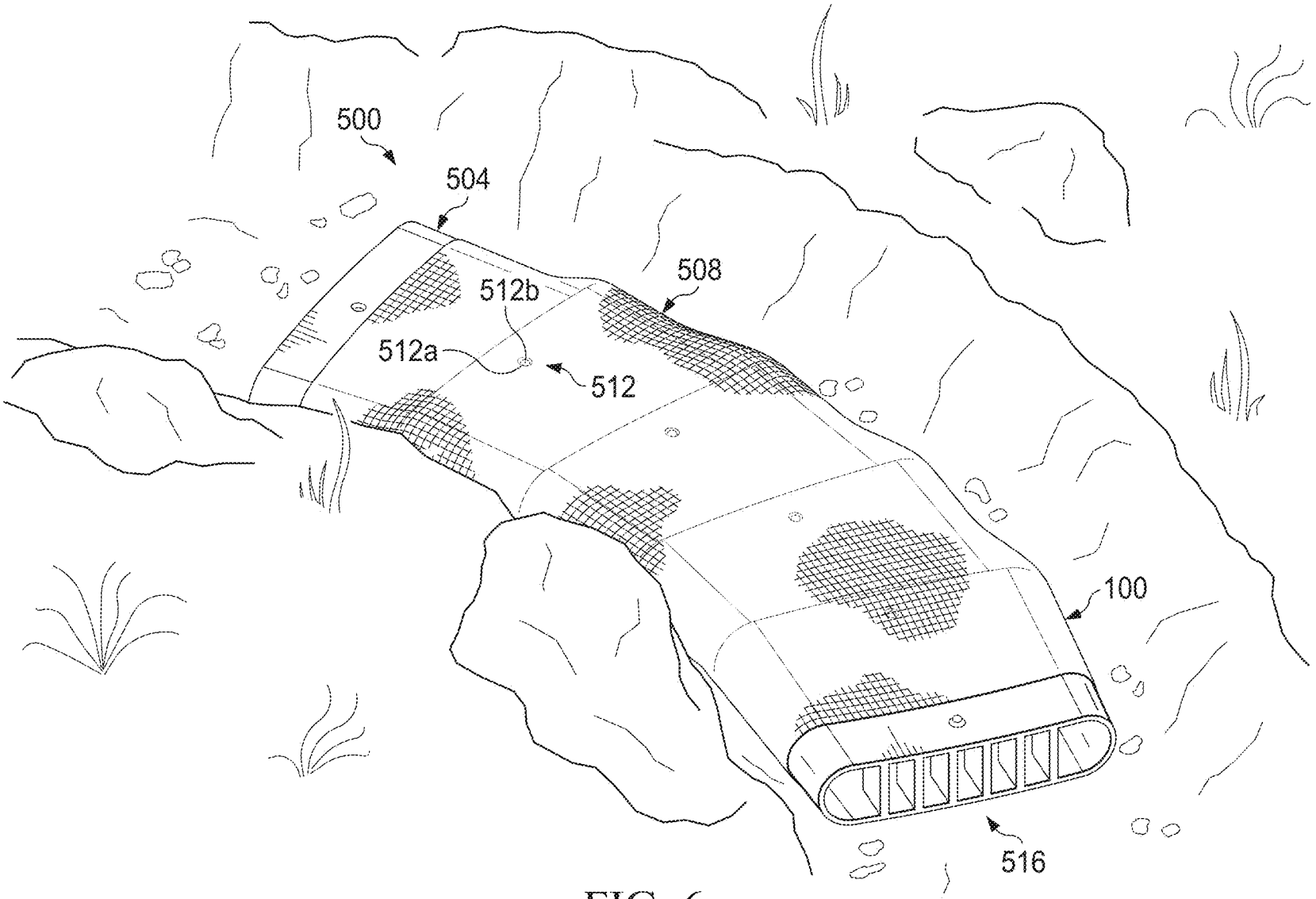
FIG. 6 illustrates an environmental perspective view of an exemplary embodiment of a plurality of interconnected drainage structure modules arranged in a curved formation.

Referring to FIG. 6, illustrated is an environmental perspective view of an exemplary embodiment of a modular drainage assembly 500 arranged in a curved configuration in accordance with the disclosed principles. In the non-limiting exemplary embodiment illustrated in FIG. 6, the curved configuration of the assembly 500 may be achieved by laterally rotating connected modules 100 along the longitudinal axis of the assembly 500. Rotation may be facilitated by the frictionally coupled outflow locking mechanisms 512 of the connected modules 100. More specifically, the outflow locking mechanism 512*b* of the first module 504 may rotate or pivot within the frictionally coupled inflow locking mechanism 512*a* of the second module 508 such that the orientation of the first module 504 relative to the second module 508 may be altered. Additionally, the amount of rotation in either direction is determined by either or both the width of the outflow end of a module as compared to the width of the inflow end of its mating module, and the distance the locking mechanisms of each module are spaced from the outer edge of the outflow end of each module. By partially rotating the plurality of interconnected modules 100 about their respective locking mechanisms 512, the shape of the assembly 500 may be tailored to the needs of the environment in which it is disposed. As a non-limiting example, the assembly 500 may be arranged in a snaking configuration by rotating successive connected modules 100 in opposite directions. In another embodiment, the assembly 500 may be arranged in a curved configuration by rotating successive connected modules 100 in the same direction. The assembly 500 may be arranged in a variety of other configurations by rotating the plurality of interconnected modules 100 in varying degrees and directions.

As illustrated in FIG. 6, the modular drainage assembly 500 may be disposed in a subsurface environment. To prevent dirt and debris from entering the assembly 500 which could obstruct the flow of fluid through the elongated fluid channel 516, the modular drainage assembly 500 may also include a cover 602. The cover 602 can at least partially surround the modular drainage assembly 500 while leaving the ends of the elongated fluid channel 516 exposed to allow fluid flow into and out of the elongated fluid channel 516. The cover 602 may be flexible to accommodate the rotation of connected modules 100 about the locking mechanisms 512. In one embodiment, the cover 602 may be a net or mesh surrounding the modular drainage assembly 500. In another embodiment, the cover 602 may be a solid sleeve formed from rubber or plastic. Other examples of covers that can achieve the same utility are within the scope of the claims.

Figure 7:
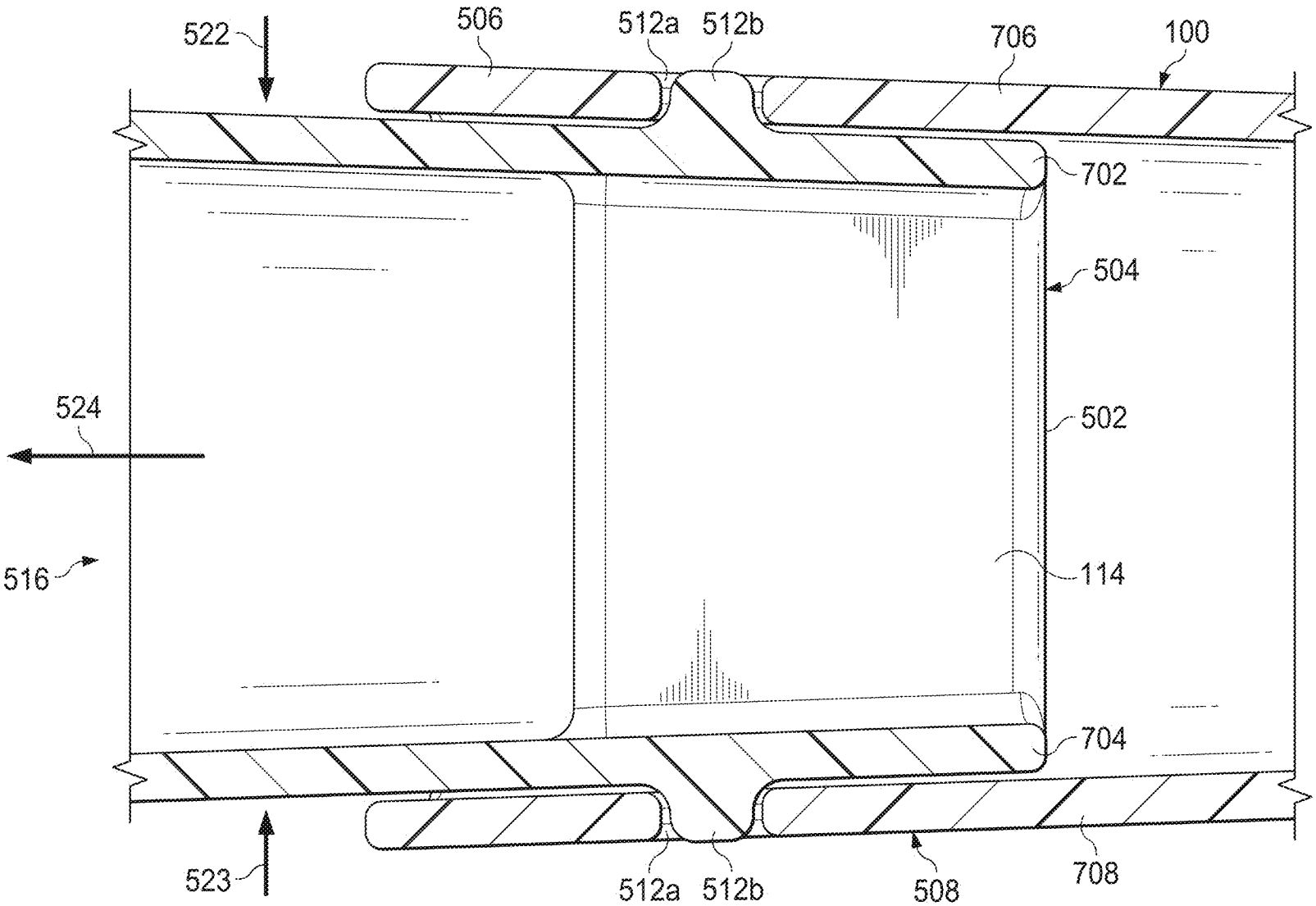
FIG. 7 illustrates a cross-sectional view of an exemplary embodiment of two connected drainage structure modules.

Referring to FIG. 7, illustrated is a cross-sectional side view of an exemplary embodiment of two connected modules 100. In this non-limiting embodiment, the two modules may be connected by nesting the outflow end 502 of a first module 504 inside of the inflow end 506 of a second module 508. As previously discussed, the support members 114 may not extend throughout the full length of the module 100. In the non-limiting example illustrated in FIG. 7, the support members 114 may be disposed near the opening at the outflow end 502 of the first module 504 and extend less than a quarter of the way down the first module 504. Furthermore, the support members 114 may not be disposed near the inflow end 506 of the second module 508 such that the inflow end 506 of the second module 508 is not obstructed by the support members 114 and is able to receive the outflow end 502 of the first module 504, as well as permit back-and-forth movement of the first module 504 within the second module 508 about the locking mechanisms 512. With the first module 504 and the second module 508 connected, the support members 114 of a first module 504 may provide structural support for the outflow end 502 of the first module 504 as well as the inflow end 506 of the second module 508.

In this non-limiting exemplary embodiment, the first module 504 may include outflow locking mechanisms 512*b* disposed on both the first planar surface 702 and the second planar surface 704. Furthermore, the second module 508 may include inflow locking mechanism 512*a* disposed on both the first planar surface 706 and the second planar surface 708. The outflow locking mechanisms 512*b* of the first module 504 may be sized and positioned to engage the inflow locking mechanisms 512*a* of the second module 508 when the first module 504 is received by the second module 508, and vice versa. In the non-limiting exemplary embodiment illustrated in FIG. 7, the inflow locking mechanisms 512*a* may be apertures sized and positioned to frictionally receive the outflow locking mechanism 512*b*, which may be generally outward facing nubs. With the locking mechanisms 512 engaged, the first module 504 and second module 508 may be securely coupled to form an elongated fluid channel 516. Fluid may flow through the elongated fluid channel 516 from the first module 504 to the second module 508. As previously discussed, the locking mechanisms 512 may also allow the first module 504 and the second module 508 to be rotatably coupled. In the non-limiting exemplary embodiment illustrated in FIG. 7, the outflow locking mechanisms 512*b* of the first module 504 may rotate within the inflow locking mechanism 512*a* of the second module 508 such that the relative position of the two modules 504, 508 may be altered.

To uncouple the first module 504 from the second module 508, the locking mechanisms 512 may be disengaged. Pressing force in the direction of arrows 522, 523 may cause the outflow locking mechanisms 512*b* of the first module 504 to disengage from the inflow locking mechanisms 512*a* of the second module 508. Alternatively, a pulling force in the direction opposite to arrows 522, 523 on the inflow end of the second module 508 may also be employed to disengage the two modules. With the locking mechanisms 512 disengaged, the first module 504 may be separated from the second module 508 by moving the first module 504 in the direction of arrow 524.

Figure 8:
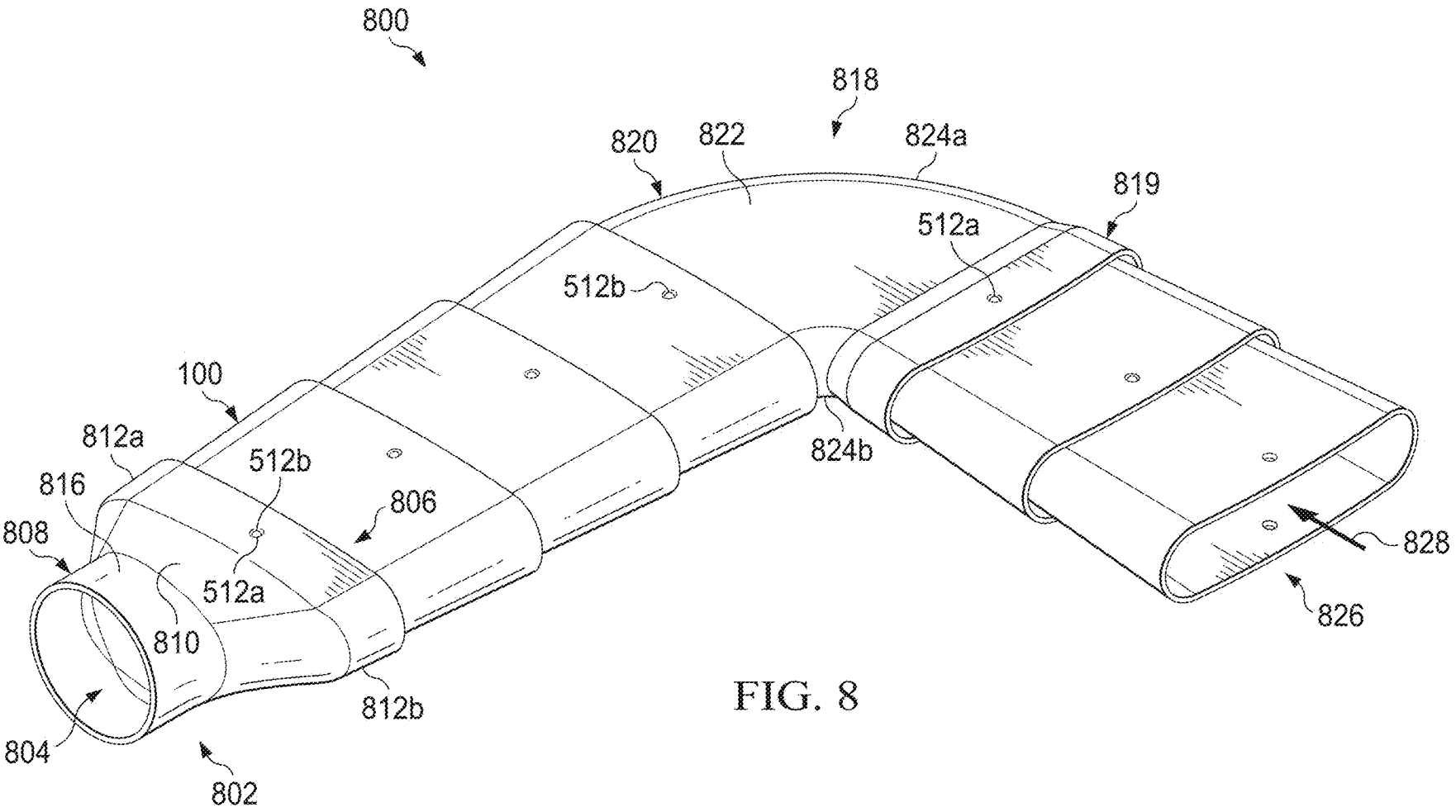
FIG. 8 illustrates a perspective view of an exemplary embodiment of a plurality of drainage structure modules including a pipe adapter and elbow joint.

Referring to FIG. 8, illustrated is a perspective view of an exemplary embodiment of a modular drainage assembly 800 in accordance with the disclosed principles. In the non-limiting exemplary embodiment illustrated in FIG. 8, the modular drainage assembly 800 includes a pipe adapter 802 for coupling the modular drainage assembly 800 to a conventional drainage pipe. The pipe adapter 802 may include a fluid channel 804 with an inflow end 806 and an outflow end 808. The fluid channel 804 may be defined by a first planar surface 810, a second planar surface (not shown) opposite the first planar surface 810, and two sidewall members 812*a*, 812*b* that join the first planar surface 810 to the second planar surface. The inflow end 806 of the pipe adapter 802 may be sized and configured to receive the outflow end 106 of a module 100.

The inflow end 806 may also include an inflow locking mechanism 512*a* sized and positioned to engage the outflow locking mechanism 512*b* at the outflow end of module 100. The fluid channel 804 of the pipe adapter 802 may also be defined by a drainpipe interface 816 sized and configured to couple to a conventional drainage pipe. In the non-limiting exemplary embodiment illustrated in FIG. 8, the drainpipe interface 816 may be a substantially cylindrical body extending from the first planar surface 810, second planar surface, and sidewall members 812*a*, 812*b*. The drainpipe interface 816 may be sized to fit a variety of conventional drainage pipes. In an embodiment, the drainpipe interface 816 may include a smooth surface for frictionally coupling the drainpipe interface 816 to a conventional drainage pipe. In another embodiment, the drainpipe interface 816 may include compression fittings or threading. The first planar surface 810, second planar surface, and the sidewall members 812*a*, 812*b* may taper to join the drainpipe interface 816.

As previously mentioned, the shape of the modular drainage assembly 800 may be tailored to the environment in which it is disposed. To further promote customizability, the modular drainage assembly 800 may include a curved elbow joint 818 to allow more acute turns than can be achieved by pivoting two connected modules 100 about the locking mechanisms 512 as previously discussed. As illustrated in the non-limiting exemplary embodiment provided in FIG. 8, the elbow joint 818 may include a fluid channel with an inflow end 819 and an outflow end 820 defined by a first planar surface 822, a second planar surface (not shown) opposite the first planar surface 822, and sidewall members 824*a*, 824*b*. The first planar surface 822 and second planar surface may be curved. Additionally, the sidewall members 824*a*, 824*b* may be differently sized, with a smaller sidewall member 824*b* and a larger sidewall member 824*a*, to join the curved first planar surface 822 to the curved second planar surface.

The curve of the elbow joint 818 can be shaped to allow the assembly 800 to turn at a variety of angles. In the non-limiting exemplary embodiment illustrated in FIG. 8, the curve of the elbow joint 818 may be shaped such that the assembly 800 may turn at a right angle. The inflow end 819 of the elbow joint 818 may be sized and configured to receive the outflow end 106 of a module 100. Likewise, the outflow end 820 of the elbow joint 818 may be sized and configured to be received by the inflow end 104 of a module 100. The elbow joint 818 may also include locking mechanisms 512 for securely and rotatably coupling the elbow joint 818 to other modules 100 in the assembly 800. More specifically, the elbow joint 818 may include an inflow locking mechanism 512*a* sized and positioned to engage the outflow locking mechanism 512*b* of a module 100, as well as an outflow locking mechanism 512*b* sized and positioned to engage the inflow locking mechanism 512*a* of a module 100. The elbow joint 818 may also include support members (not shown) disposed near the outflow end 820 of the elbow joint 818 to provide structural support.

A plurality of modules 100, elbow joint 820, and a pipe adapter 802 may be interconnected to form a modular drainage assembly 800, wherein the fluid channels of each component align to form an elongated fluid channel 826. Fluid may thereby flow through the elongated fluid channel 826 in the direction of arrow 828.

Figure 9:
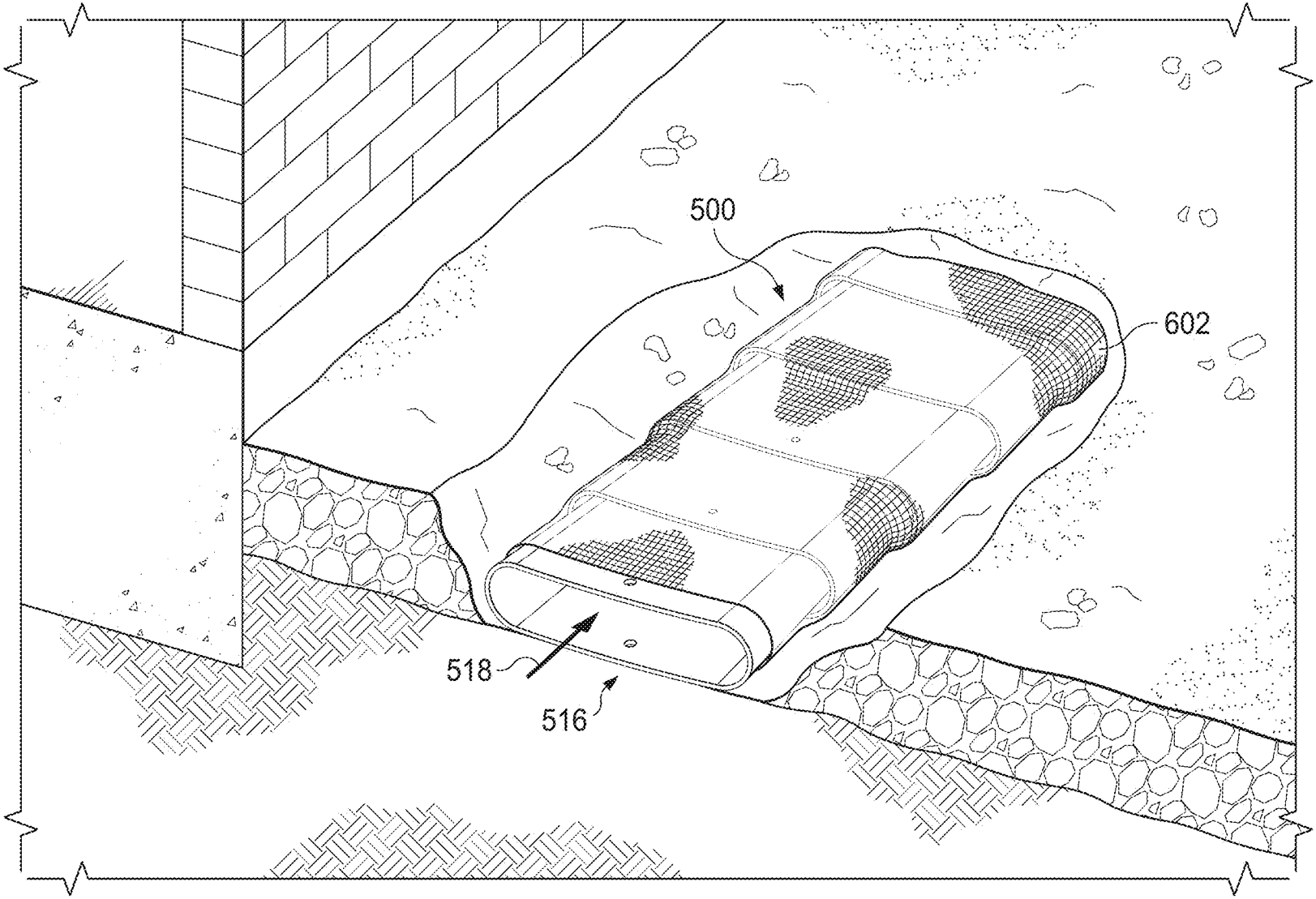
FIG. 9 illustrates an environmental perspective view of an exemplary embodiment of a plurality of interconnected drainage structure modules.

Referring to FIG. 9, illustrated is an environmental perspective view of an exemplary embodiment of a modular drainage assembly 500 in accordance with the disclosed principles, but depicted as a partial cutaway drawing. As previously discussed, the modular drainage assembly 500 may be disposed in a subsurface environment. In the non-limiting exemplary embodiment illustrated in FIG. 9, the assembly 500 may be at least partially buried such that fluid may flow through the subsurface environment via the elongated fluid channel 516 in the direction of arrow 518. Fluid may thereby be transported away from structures to prevent water accumulation and associated damage without the assembly 500 being exposed, thus preserving the landscape's appearance and protecting the assembly 500 from damage. The modular drainage assembly 500 may also include a cover 602 to prevent dirt and debris from the subsurface environment from entering the assembly 500. In another embodiment, the assembly 500 may be disposed above the ground surface.

Figure 10:
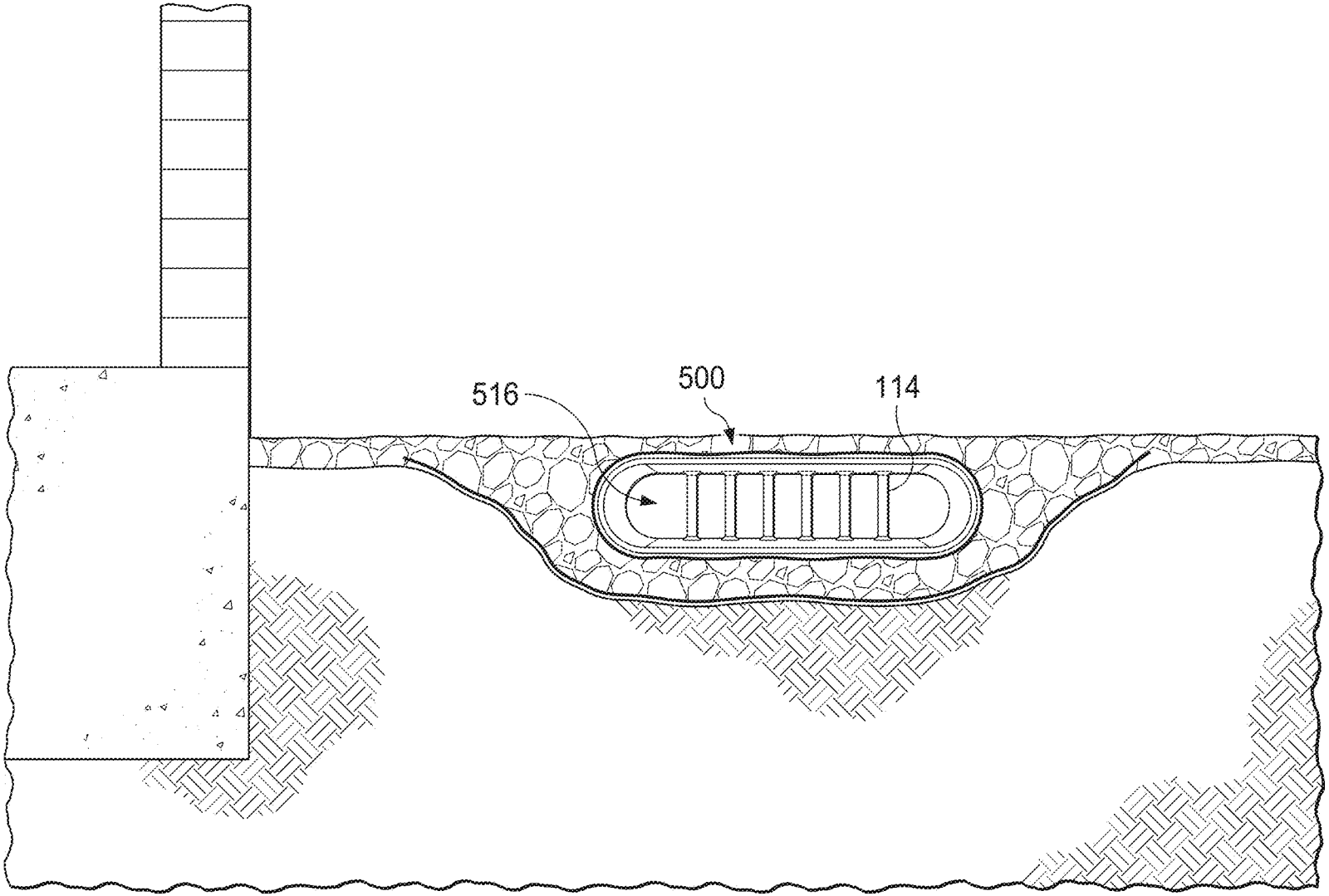
FIG. 10 illustrates an environmental cross-section view of an exemplary embodiment of a plurality of interconnected drainage structure modules.

Referring to FIG. 10, illustrated is an environmental cross-section of an exemplary embodiment of a modular drainage assembly 500 in accordance with the disclosed principles. In the non-limiting exemplary embodiment illustrated in FIG. 10, the modular drainage assembly 500 may be buried below the surface such that fluid may flow through the subsurface environment via the elongated fluid channel 516. The elongated fluid channel 516 may be tapered such that fluid may flow through the elongated fluid channel 516 in a desired direction. As previously discussed, support members 114 may provide structural support for the assembly 500 to prevent deformation and damage from external forces such as soil movement and overhead weight.

Figure 11:
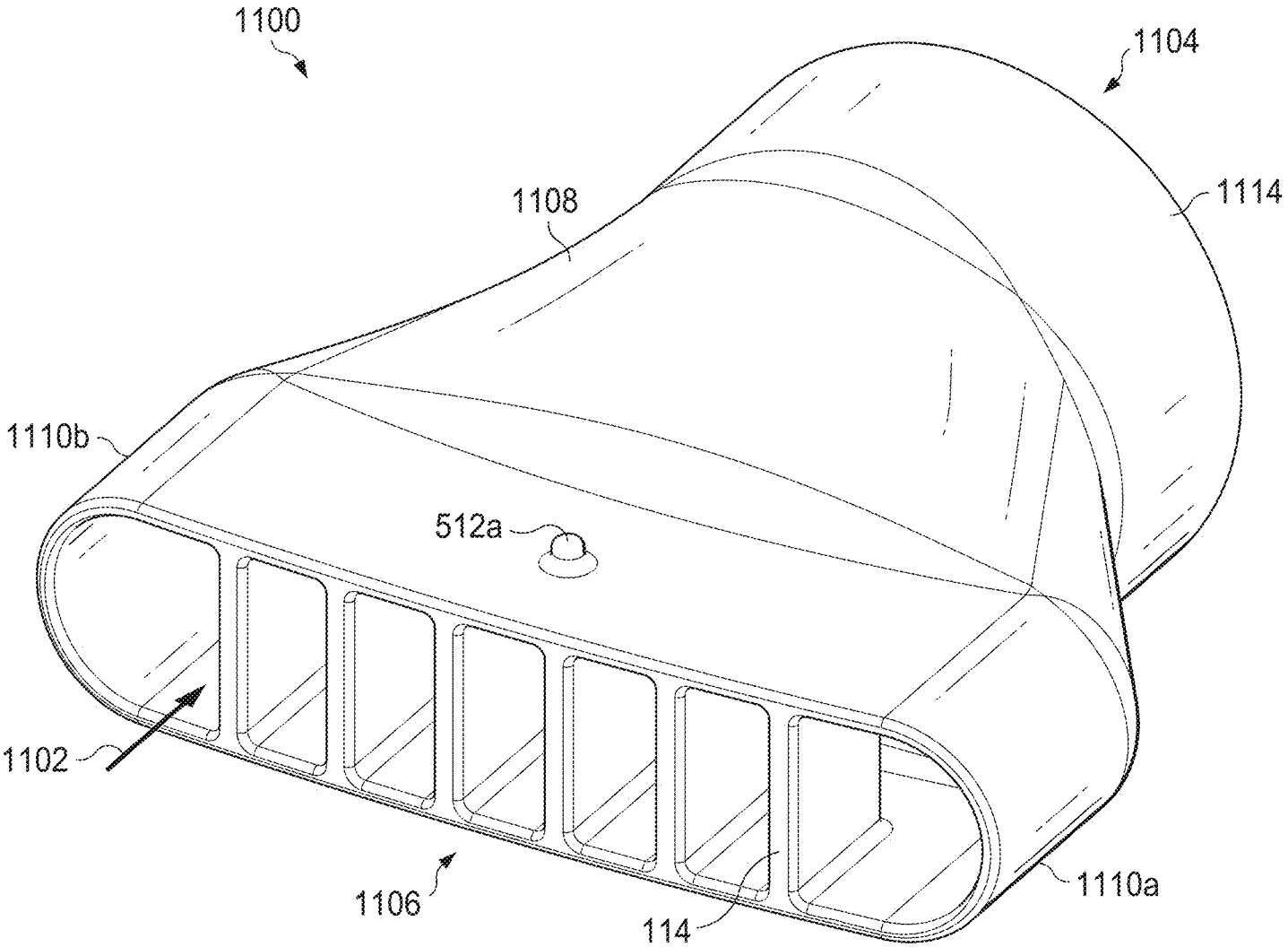
FIG. 11 illustrates a perspective view of an exemplary embodiment of a pipe adapter designed and constructed in accordance with the disclosed principles.

Referring to FIG. 11, illustrated is a perspective view of an exemplary embodiment of a pipe adapter 1100 for coupling a modular drainage assembly to a conventional drainage pipe in accordance with the disclosed principles. In the non-limiting exemplary embodiment illustrated in FIG. 11, the pipe adapter 1100 may include a fluid channel 1102 with an inflow end 1104 and an outflow end 1106. The fluid channel 1102 may be defined by a first planar surface 1108, a second planar surface (not shown) opposite the first planar surface 1108, and two sidewall members 1110*a*, 1110*b* that join the first planar surface 1108 to the second planar surface. The outflow end 1106 of the pipe adapter 1100 may be sized and configured to be received by the inflow end of a disclosed module (not shown). The outflow end 1106 of the pipe adapter 1100 may also include support members 114 to provide structural support for the pipe adapter 1100 and a modular drainage assembly.

The outflow end 1106 may also include an outflow locking mechanism 512*a* sized and positioned to engage an inflow locking mechanism (not shown) at the inflow end of a disclosed module (not shown). The fluid channel 1102 of the pipe adapter 1100, and particularly the inflow end 1104, may also be defined by a drainpipe interface 1114 sized and configured to couple to a conventional drainage pipe. In the non-limiting exemplary embodiment illustrated in FIG. 11, the drainpipe interface 1114 may be a substantially cylindrical body extending from the first planar surface 1108, second planar surface, and sidewall members 1110*a*, 1110*b*. The drainpipe interface 1114 may be sized to fit a variety of conventional drainage pipes. In an embodiment, the drainpipe interface 1114 may include a smooth surface for frictionally coupling the drainpipe interface 1114 to a conventional drainage pipe. In another embodiment, the drainpipe interface 1114 may include compression fittings or threading. The first planar surface 1108, second planar surface, and the sidewall members 1110*a*, 1110*b* of the pipe adapter 1110 may taper to join the drainpipe interface 1114.

While this disclosure has been particularly shown and described with reference to preferred embodiments, it will be understood by those skilled in the pertinent field of art that various changes in form and detail may be made therein without departing from the spirit and scope of the disclosed principles. The inventors expect skilled artisans to employ such variations as appropriate, and the inventors intend the disclosed principles to be practiced otherwise than as specifically described herein. Accordingly, this disclosure includes all modifications and equivalents of the subject matter recited in the claims appended hereto, as permitted by applicable law. Moreover, any combination of the above-described elements in all possible variations thereof is encompassed by the disclosure unless otherwise indicated herein or otherwise clearly contradicted by context.

Also, while various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the disclosed principles set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" or disclosed principles in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

Moreover, the Abstract is provided to comply with 37 C.F.R. § 1.72 (b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus, the following claims are hereby incorporated into the Detailed Description, with each claim standing on its own as a separate embodiment.

Any and all publications, patents, and patent applications cited in this disclosure are herein incorporated by reference as if each were specifically and individually indicated to be incorporated by reference and set forth in its entirety herein.

I claim:

1. A drainage assembly module, comprising:

a body formed from a plurality of walls that define an enclosed fluid channel extending from an inflow end to an outflow end, wherein at least two opposing walls of the plurality of walls continuously taper along the entirety of a length of the body from the inflow end to the outflow end;

at least one support member extending from at least one of the walls and spanning the fluid channel, wherein the at least one support member is disposed in at least a portion of the outflow end and wherein the at least one support member is not disposed in a portion of the inflow end;

a first locking mechanism disposed on at least one of the walls and located proximate to an opening at the outflow end;

a second locking mechanism disposed on at least one of the walls and located proximate to an opening at the inflow end, wherein:

the opening at the inflow end has a first cross-sectional area, the opening at the outflow end has a second cross-sectional area that is smaller than the first cross-sectional area, and the first locking mechanism is configured to removably engage with the second locking mechanism.

2. The drainage assembly module of claim 1, wherein the plurality of walls comprises:

a first planar member, a second planar member spaced from and opposing the first planar member, and opposing sidewall members connecting outer edges of the first and second planar members.

3. The drainage assembly module of claim 2, wherein the sidewall members comprise opposing semicircular segments, and wherein the transverse cross-sectional area of the opening at the inflow end and the opening at the outflow end each comprise a stadium shape.

4. The drainage assembly module of claim 1, wherein a first end of the at least one support member engages one of the plurality of walls and a second end of the at least one support member engages an opposing one of the plurality of walls.

5. The drainage assembly module of claim 1, wherein material comprising the inflow end is flexible.

6. The drainage assembly module of claim 1, wherein the first locking mechanism is further configured to rotatably engage with the second locking mechanism.

7. The drain assembly module of claim 6, wherein the first locking mechanism comprises a nub and the second locking mechanism comprises an aperture sized to frictionally receive the nub.

8. The drain assembly module of claim 1, wherein the body is rigid and curved along its longitudinal axis.

9. A drainage system, comprising:

a first drainage assembly module; and a second drainage assembly module removably coupled to the first drainage assembly module, wherein each drainage assembly module comprises:

a body formed from a plurality of walls that define an enclosed fluid channel extending from an inflow end to an outflow end, wherein at least two opposing walls of the plurality of walls continuously taper along the entirety of a length of the body from the inflow end to the outflow end;

at least one support member extending from at least one of the walls and spanning the fluid channel, wherein the at least one support member is disposed in at least a portion of the outflow end and wherein the at least one support member is not disposed in a portion of the inflow end;

a first locking mechanism disposed on at least one of the walls and located proximate to an opening at the outflow end;

a second locking mechanism disposed on at least one of the walls and located proximate to an opening at the inflow end, wherein:

the opening at the inflow end has a first cross-sectional area, the opening at the outflow end has a second cross-sectional area that is smaller than the first cross-sectional area, and the first locking mechanism is configured to removably engage with the second locking mechanism, and wherein the first locking mechanism of the first drainage assembly module is removably engaged with the second locking mechanism of the second drainage assembly module to form an elongated fluid channel extending from the inflow end of the first drainage assembly module to the outflow end of the second drainage assembly module.

10. The drainage system of claim 9, wherein each fluid channel tapers from the inflow end toward the outflow end.

11. The drainage system of claim 9, wherein the inflow end of the second drainage assembly module is configured to receive the outflow end of the first drainage assembly module therein.

12. The drainage system of claim 9, wherein the first locking mechanism of the first drainage assembly module is rotatably engaged with the second locking mechanism of the second drainage assembly module.

13. The drainage system of claim 9, further comprising a drainpipe interface coupled to the outflow end of the second drainage assembly module.

14. The drainage system of claim 9, further comprising an elbow joint coupled to either the outflow end of the second drainage assembly module or the inflow end of the first drainage assembly module.

15. The drainage system of claim 9, further comprising a cover configured to prevent debris from entering the elongated fluid channel.

16. The drainage system of claim 15, wherein the cover is a mesh or net.

17. The drainage system of claim 15, wherein the cover is a solid sleeve.

18. The drainage system of claim 9, wherein the plurality of walls comprises:

a first planar member, a second planar member spaced from and opposing the first planar member, and opposing sidewall members connecting outer edges of the first and second planar members.

19. The drainage system of claim 9, wherein the drainage assembly modules are rigid and curved along their longitudinal axes.

* * * * *